United States Patent [19]

Verdugo et al.

[11] 4,221,366

[45] Sep. 9, 1980

[54] GAS DISTRIBUTING CLOSURE PLUG FOR METALLURGICAL REACTOR

[75] Inventors: Marco A. F. Verdugo, Monterrey; Leobardo C. Martinez, San Nicolas de los Garza, both of Mexico

[73] Assignee: Hylsa, S.A., Monterrey, Mexico

[21] Appl. No.: 5,792

[22] Filed: Jan. 23, 1979

Related U.S. Application Data

[63] Continuation-in-part of Ser. No. 876,362, Feb. 9, 1978, abandoned.

[51] Int. Cl.[3] ..... C21B 7/08

[52] U.S. Cl. ..... 266/197; 266/195; 266/186

[58] Field of Search ..... 266/156, 159, 186, 187, 266/188, 189, 195, 197, 198, 199; 75/33, 34, 35, 36, 37, 91

[56] References Cited

U.S. PATENT DOCUMENTS

| | | | |
|---|---|---|---|
| 113,401 | 4/1871 | Cox | 266/188 |
| 446,996 | 2/1891 | Phelps et al. | 266/195 |
| 2,670,946 | 3/1954 | Royster | 266/80 |
| 3,467,368 | 9/1969 | Calada et al. | 266/193 |
| 3,610,602 | 10/1971 | Deacon | 266/220 |
| 3,619,172 | 11/1971 | Lutgen | 75/59 |
| 3,640,702 | 2/1972 | Karinthi et al. | 75/59 |
| 3,836,131 | 9/1974 | Beggs | 266/168 |
| 3,973,761 | 8/1976 | Pelletier et al. | 266/187 |

FOREIGN PATENT DOCUMENTS

| | | | |
|---|---|---|---|
| 546104 | 6/1942 | United Kingdom | 75/34 |

*Primary Examiner*—L. Dewayne Rutledge
*Assistant Examiner*—John P. Sheehan
*Attorney, Agent, or Firm*—Curtis, Morris & Safford

[57] ABSTRACT

Improved cooling of sponge iron in the cooling reactor of a multi-stage gaseous reduction system for particulate iron ore is achieved by using a hollow foraminous closure plug at the bottom of the reactor. The plug is pivotally mounted for movement from a reactor-closing to a reactor-discharge position and has a cooling gas inlet nipple which, when the plug is in its reactor-closing position, registers with the discharge end of a cooling gas supply conduit to cause cooling gas to flow into the plug and through the wall thereof to cool the adjacent portion of the sponge iron bed within the reactor. The plug can also be used to distribute hot gas to an ore bed in a reduction reactor.

18 Claims, 9 Drawing Figures

GAS DISTRIBUTING CLOSURE PLUG FOR METALLURGICAL REACTOR

This application is a continuation-in-part of application Ser. No. 876,362 filed Feb. 9, 1978, and now abandoned.

This invention relates to an improvement in reactors of the type that are commonly used in the gaseous reduction of fixed beds of particulate metal ores. For convenience the reactor will be described as applied to the reduction of iron ore and to the cooling of the sponge iron thus produced, although as the description proceeds, it will become apparent that the reactor can also be used in the treatment of other types of ores as well.

Such reactors are commonly used in multi-stage batch systems wherein the reactors are so interconnected as to be functionally interchangeable at the end of a predetermined period of operation. If, for example, the reduction system comprises a first and second stage reduction reactor, a cooling reactor and a charging and discharging reactor, the connections between the reactors at the end of each operating cycle are shifted to cause the first stage reduction reactor to become a second stage reduction reactor, the second stage reduction reactor to become a cooling reactor, the cooling reactor to become a discharging and charging reactor, and the freshly charged reactor to become a first stage reduction reactor. In the following description a reactor at the cooling stage will be referred to as a cooling reactor and a reactor at the reduction stage will be referred to as a reduction reactor, although it is evident that each reactor will at one time be a cooling reactor and at another time a reduction reactor. Systems of this type are disclosed in U.S. Pat. Nos. 3,136,623; 3,423,201; and 3,890,142. As shown in these patents, such systems include, in addition to two or more reduction reactors, a cooling reactor for cooling the reduced ore from the reducing temperature to a temperature close to that of the ambient atmosphere. The present invention is especially useful when incorporated in a reactor structure to provide improved cooling of the sponge iron produced by reduction of the iron ore, although as pointed out below, it may also be used to achieve improved gas distribution in a reduction reactor.

In the prior art fixed bed systems the reactors are provided at the bottom with a downwardly converging discharge zone such as that shown in Celada et al. U.S. Pat. No. 3,467,368, and may have a removable closure plug at the bottom thereof. The plug is movable from a reactor-closing position wherein it closes and seals the discharge port of the reactor to a reactor-discharge position to one side of the discharge port so that the particulate sponge iron can flow out of the reactor. The plug can be mounted on a pivoted arm and suitable hydraulic mechanism provided for moving the plug between its operative and inoperative positions.

In a gaseous reduction system of the type disclosed in the above patents the cooling of the sponge iron is an important part of the process. Upon removal from the reactor the sponge iron has a tendency to reoxidize, especially if portions of the product are insufficiently cooled. In general the reoxidation reactions are exothermic and temperature sensitive. Hence hot spots in the mass of sponge iron removed from the reactor can initiate a chain reaction leading to a considerable decrease in the degree of metallization. In an integrated steel mill where the discharged sponge iron is transferred in a relatively short period of time to a steel-making furnace, the tendency of the sponge iron to reoxidize does not ordinarily cause any difficulty. However, where the sponge iron is to be stored for an extended period of time in contact with atmospheric air or shipped to a remote point for use, hot spots may initiate reoxidation of the iron.

In conventional systems of the type disclosed in the above patents cooling of the sponge iron is effected by passing a current of cooled gas downwardly through the hot reduced sponge iron bed. While theoretically any cool, non-oxidizing gas could be used, it has been customary to use the fresh reducing gas as a cooling medium and then pass it in series through the reduction reactors of the system for effecting reduction of the iron ore. The downwardly flowing cooling gas is removed through a plenum chamber near the bottom of the reactor, then cooled and a portion thereof recycled for further cooling of the sponge iron bed in the cooling reactor. The remainder of the cooled gas flows to the last stage reduction reactor. The flow pattern within the cooling reactor is such that a small portion of the sponge iron bed at the very bottom of the reactor is out of the main stream of cooling gas flow. With this flow pattern it becomes possible for a certain proportion of the sponge iron particles at the very bottom of the reactor to be insufficiently cooled. Such insufficiently cooled sponge iron particles can form "hot spots" in the mass of discharged sponge iron. While such "hot spots" can be eliminated by spreading the sponge iron over a large area and quenching the spots individually, the elimination of "hot spots" in this way is a laborious and time-consuming process.

It is accordingly an object of the present invention to provide an improved method of cooling the sponge iron in a fixed bed of sponge iron in a cooling reactor of a gaseous iron ore reduction system. It is another object of the invention to so modify the structure of a reactor of a gaseous reduction system as to provide improved gas distribution in a bed of metal-bearing material in the reactor. It is a further object of the invention to provide cooling at the very bottom of a cooling reactor without complicating the structure of the reactor and without introducing structural elements that might interfere with the free flow of sponge iron during discharge of the reactor. Other objects of the invention will be in part obvious and in part pointed out hereafter.

The objects of the invention are achieved in general by utilizing the conventional bottom closure plug of the reactor as a distributor for a supplemental current of cooling or reducing gas. More particularly, a hollow plug is used and the interior of the plug is connected to a source of gas. Openings are formed in the wall of the plug so that the gas fed to the interior of the plug can flow through the wall of the plug into contact with sponge iron or partially reduced iron ore at the bottom of the reactor.

The objects and advantages of the invention can best be understood and appreciated by reference to the accompanying drawings which illustrate a preferred embodiment of the invention and wherein:

FIG. 1 is a semi-diagrammatic vertical section through a cooling reactor showing a bottom closure plug incorporating the present invention in its reactor-closing position;

FIG. 2 ia an enlarged vertical section taken through the lower portion of the reactor showing the plug in elevation in its reactor-closing position;

Figure 1:
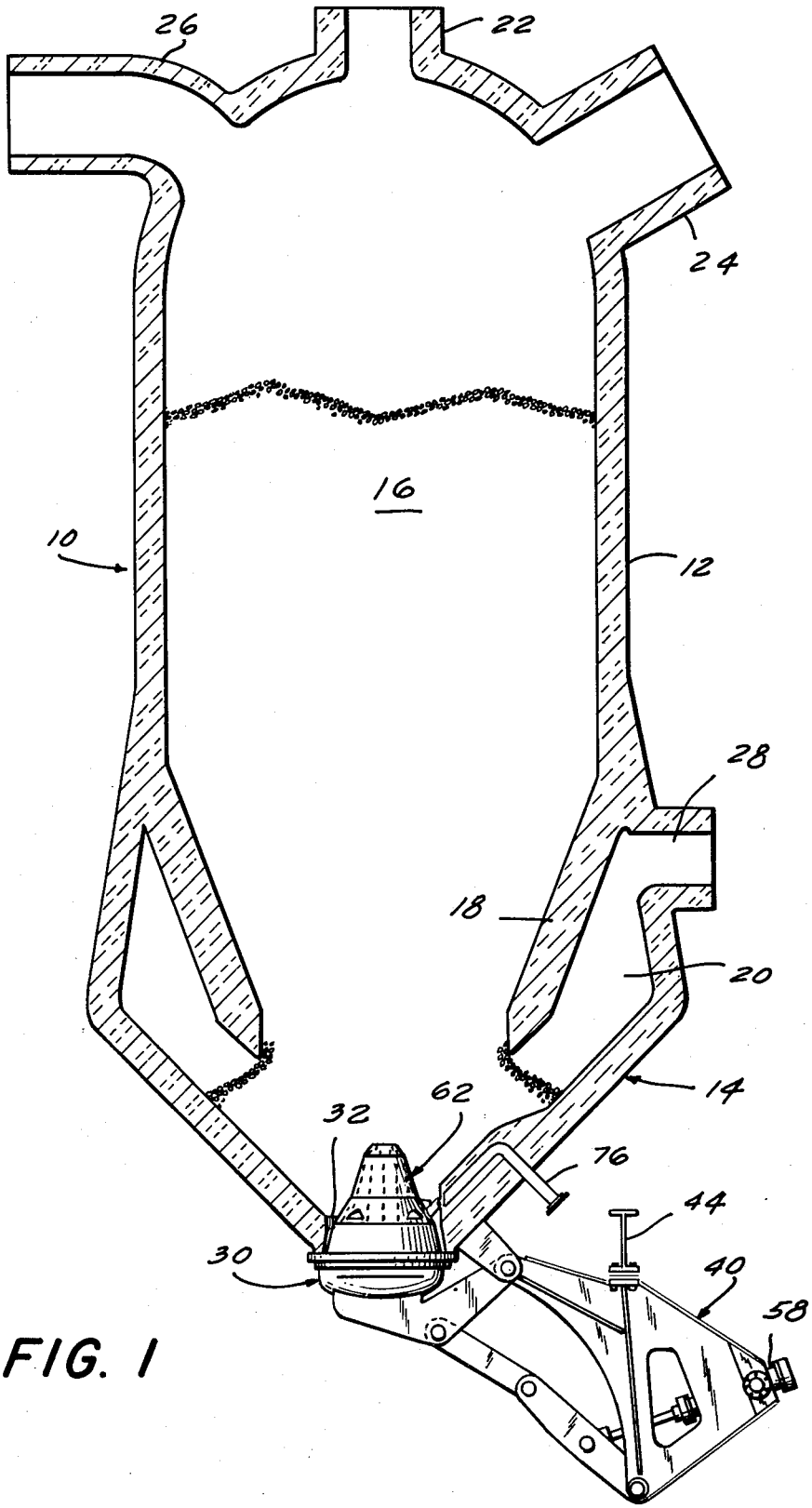

Referring to the drawings, and more particularly to FIG. 1, the cooling reactor 10 there shown is of a generally cylindrical configuration and has a refractory insulated wall 12, the lower portion of which converges to form a bottom section 14. Within the reactor 10 there is a bed 16 of particulate sponge iron made by reduction of iron ore in a previous cycle of operations. In the bottom section 14 there is a frusto-conical baffle 18 that cooperates with the wall of the reactor to form a plenum chamber 20 through which gas may flow.

The reactor 10 has a number of inlet and outlet ports as shown. Thus there is an inlet connection 22 at the top of the reactor through which the reactor may be charged with particulate iron ore to be reduced. Also at the top of the reactor there is an inlet connection 24 that can be used to admit hot reducing gas for reducing the iron ore during the reduction cycle within the reactor. The connection 24 is out of service during the cooling cycle which is described herein. The third connection near the top of the reactor identified by the numeral 26 serves as an inlet for the cooling gas used to cool the sponge iron formed in the ore reduction cycle of the operation. The cooling gas flows down through the particulate bed of sponge iron 16 under the bottom of the baffle 18 into the plenum chamber 20 and then leaves the reactor through discharge connection 28. At the bottom of the reactor there is a closure plug 30 which during the normal operation of the reactor, i.e., the reduction and cooling cycles, is positioned within and seals a discharge port 32 through which the reduced and cooled sponge iron can be discharged from the reactor.

Figure 2:
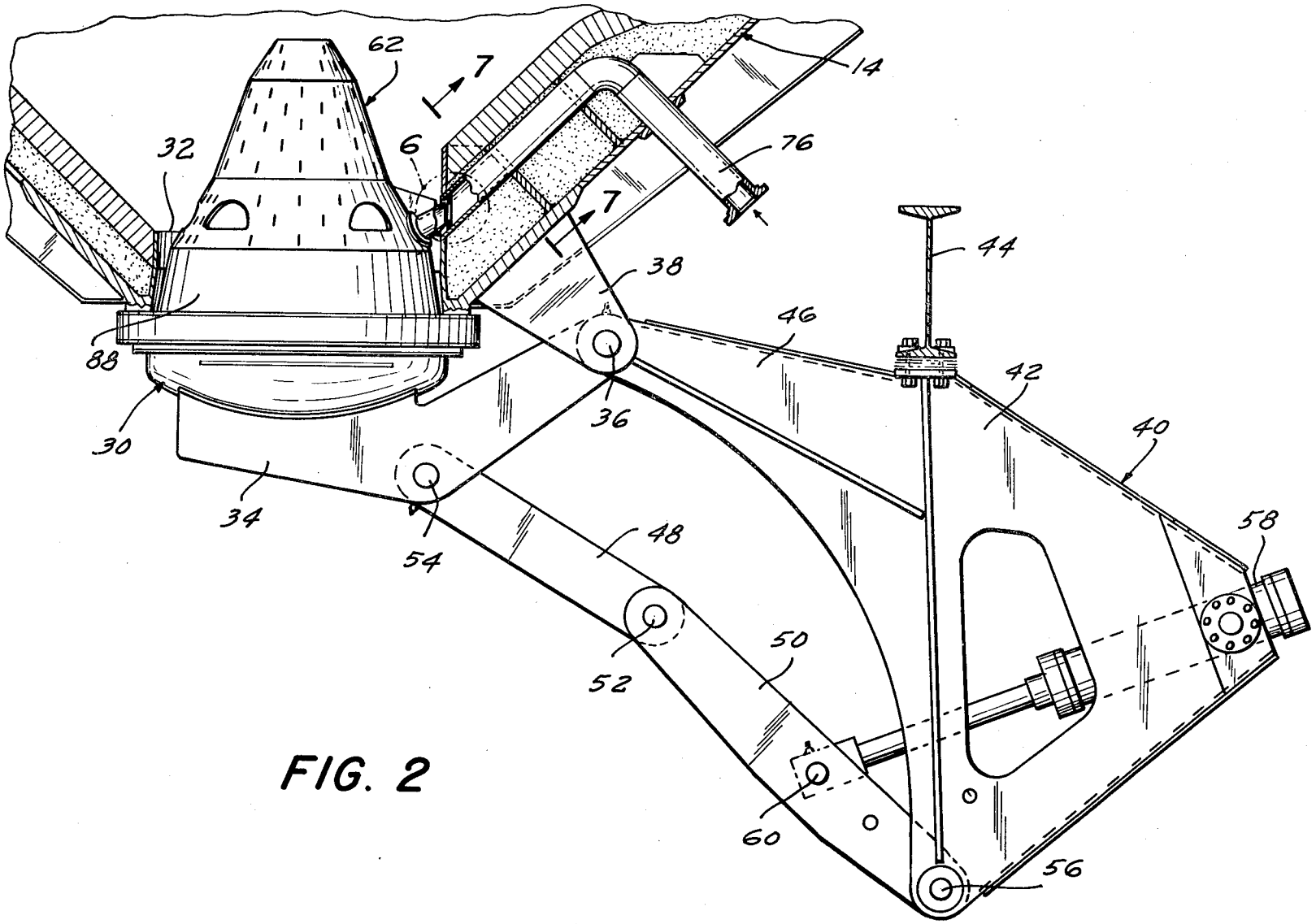
Figure 3:
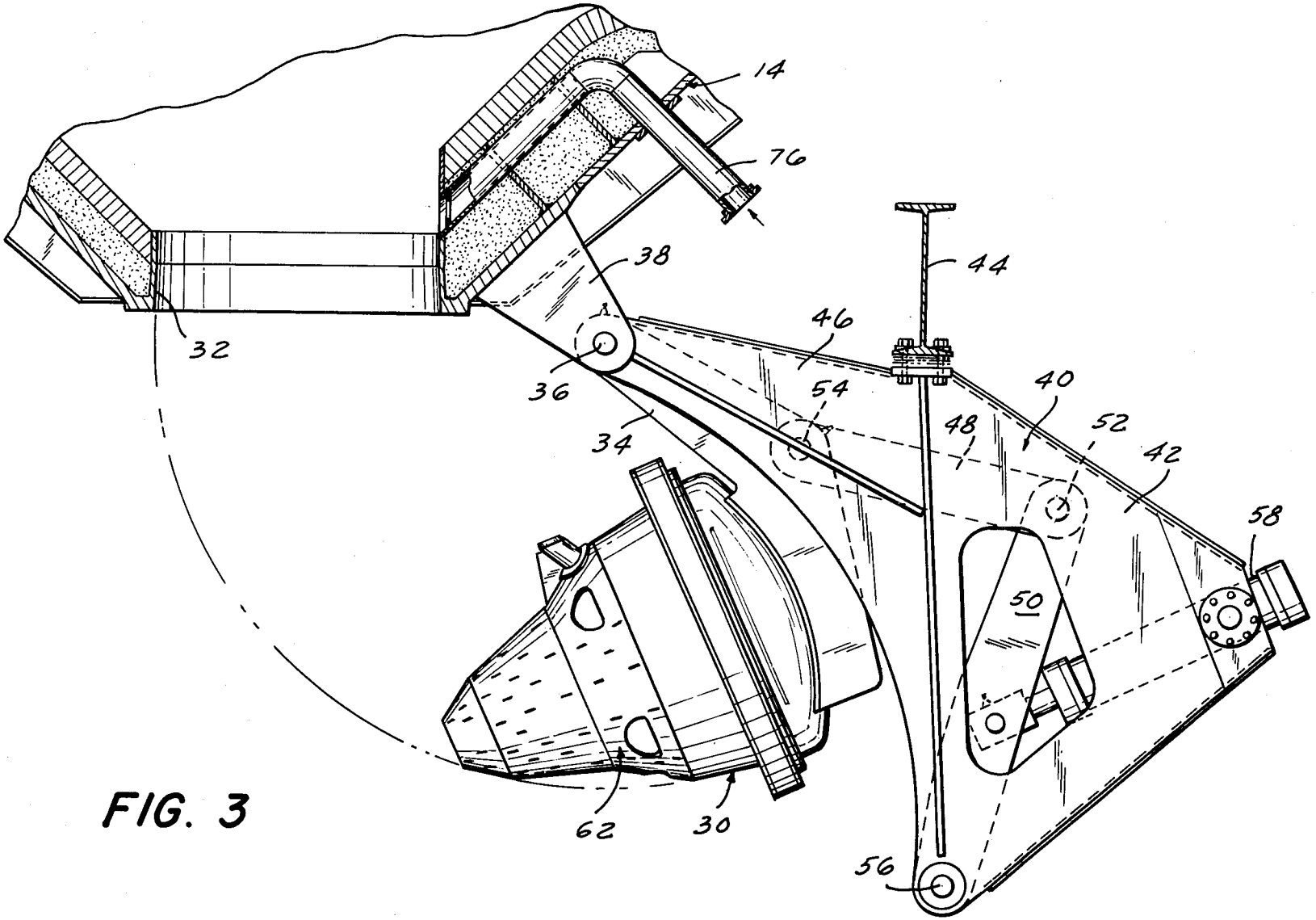
FIG. 3 is a view similar to FIG. 2 but showing the closure plug in its reactor-discharge position.

Referring now to FIGS. 2 and 3 of the drawings, the plug 30 is movable from a reactor-closing position as shown in FIG. 2 wherein it is positioned within and seals the discharge port 32 to a reactor-discharge position as shown in FIG. 3 wherein it is positioned away from the port 32 to permit cooled sponge iron to be discharged from the reactor through the discharge port. Fixed to the bottom of the plug 30 there is an arm 34 which at its end remote from the plug is connected by a pivot pin 36 to a brace 38 secured to the exterior wall of the reactor in such manner that the plug is swingable about the pivot 36 between its reactor-closing position and its reactor-discharge position.

Swinging movement of the plug is effected by means of an actuating mechanism 40 comprising a frame 42 secured to and supported by a fixed I-beam 44. An arm 46 of the frame 42 is secured to pivot 36 to provide additional support for the swinging plug. Movement of the plug 30 is effected by a hydraulically operated toggle mechanism mounted on the frame 42. The toggle mechanism comprises the links 48 and 50, connected at their adjacent ends by a pivot pin 52. The distal end of link 48 is connected to the elbow of arm 34 by a pivot pin 54 and the distal end of link 50 is connected to frame 42 by a pivot pin 56. A hydraulic cylinder 58 is mounted on the frame 42 and has a piston rod pivotally secured to an intermediate point of the link 50 by the pivot pin 60. The hydraulic cylinder 58 is supplied with hydraulic fluid in known manner and operates through the toggle linkage 48-50 to move the plug 30 into its reactor-closing position or its reactor-discharge position as desired.

Figure 4:
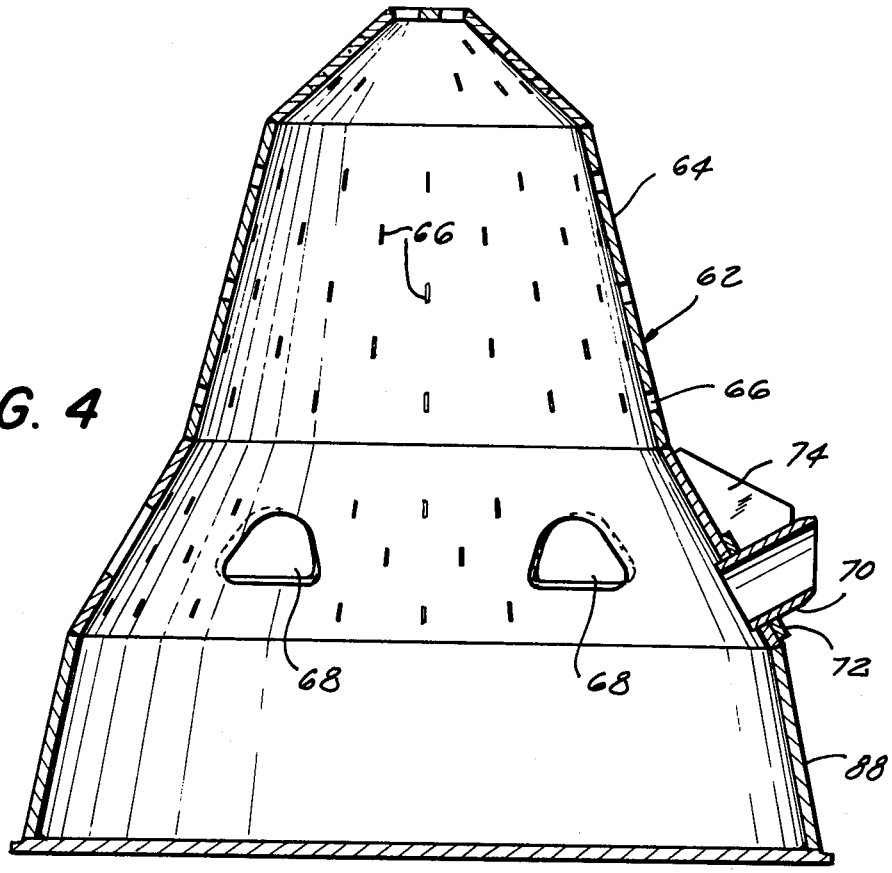
FIG. 4 is a still further enlarged vertical section through the closure plug showing the interior of the plug.
Figure 5:
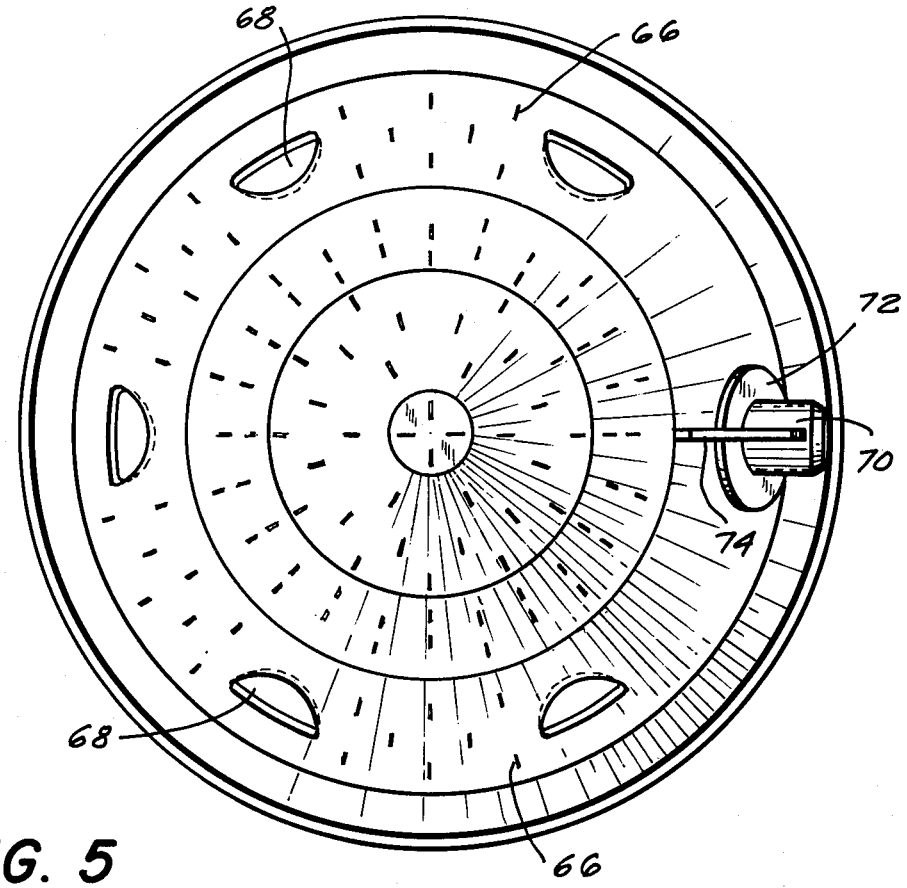
FIG. 5 is a top plan view of the plug as shown in FIG. 4.

As indicated above, the plug 30 is so constructed as to permit its use as a source of cooling gas for cooling the bed of sponge iron within the reactor. Referring to FIGS. 4 and 5, as well as to FIGS. 2 and 3, the plug 30 is provided with a hollow, generally frusto-conical head 62 defining an unobstructed frusto-conical chamber and having a relatively thin wall 64 pierced by the slots 66 through which cooling gas may flow. As shown in FIG. 4, the slots 66 may be lateral openings formed in the side wall of the plug and may also be formed in the top of the plug.

At a level slightly below the middle of head 62 the wall 64 is provided with a series of relatively large openings 68. These larger openings are provided to facilitate removal from the interior of the head 62 any sponge iron particles that may penetrate to the interior of the head of the plug. For admission of cooling gas to the plug the head 62 is provided with a gas inlet nipple 70 secured through a collar 72 to the exterior of wall 64. A brace 74 is secured to wall 64 and nipple 70 to provide structural strength.

Figure 6:
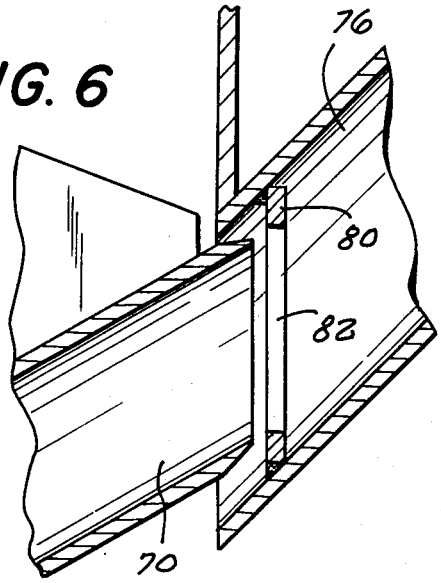
FIG. 6 is a detailed section showing the operative relationship between the gas inlet connection of the closure plug and the cooling gas supply conduit.
Figure 7:
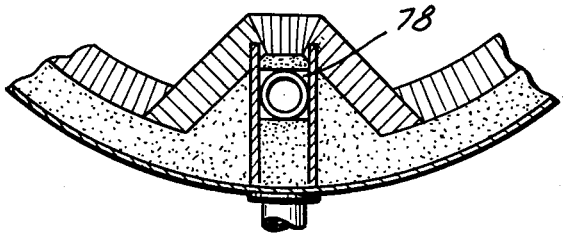
FIG. 7 is a section taken on the line 7—7 of FIG. 2 and further showing the location of the cooling gas supply conduit within the wall of the reactor.

Reverting now to FIG. 2 and referring also to FIG. 7, supplementary cooling gas to be supplied to the head 62 of plug 30 enters the reactor through a pipe 76 that is largely positioned within the reactor wall. Thus the inner portion of pipe 76 is positioned within a channel 78, the central axis of which is generally parallel to the exterior wall of the reactor. The gas supply pipe 76 supplies supplemental cooling gas to the inlet nipple 70 of plug 30 in a manner best shown in FIG. 6. Referring to FIG. 6, the interior of the discharge end of pipe 76 has a ring 80 secured thereto having a central opening 82 that registers with the inlet end of nipple 70 when the plug is in its reactor-closing position. Thus when cooling gas is supplied to the lower part of the reactor through pipe 76, most of it flows through the nipple 70 into the interior of plug 30 and is then distributed through the slots 66 to the sponge iron in the bottom of the reactor. In this way the portion of the sponge iron that is outside the main stream of cooling gas flowing around the bottom of the baffle 18 into the plenum chamber 20 is thoroughly cooled before being discharged from the reactor.

Figure 8:
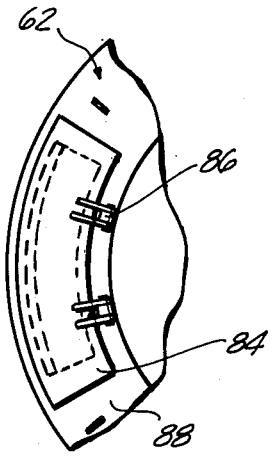
FIG. 8 is a fragmentary view of the skirt of the closure plug showing a modification of the plug wherein a hinged door is provided to facilitate cleaning the interior of the plug.

It has been found that over a long period of time there is a tendency for fine particles of sponge iron to penetrate into the interior of the head of plug 30. To facilitate removal of particulate material from the interior of the head, a cleanout door may be provided in the lower portion of the head as illustrated in FIG. 8 of the drawings. Referring to FIG. 8, an arcuate door 84 is secured by hinges 86 to the skirt 88 of head 62. The door 84 is so located and hinged that it opens due to the force of gravity as the plug 30 moves to its reactor-discharge position.

As indicated above, the perforated plug 30 is also useful when incorporated in a reduction reactor. In a typical reduction reactor of a batch system such as that described herein the main stream of reducing gas is heated outside the reactor, introduced near the top of the reactor, e.g., through connection 24, and flows down through the bed of iron-bearing material therein. The flow pattern in the reduction reactor, like that in the cooling reactor, is such that a small portion of the bed at the bottom of the reactor is outside of the main stream of reducing gas flow. By supplying a second stream of hot reducing gas to the plug 30 at the bottom of the reactor, the reducing capacity of the reactor can be more fully utilized.

Figure 9:
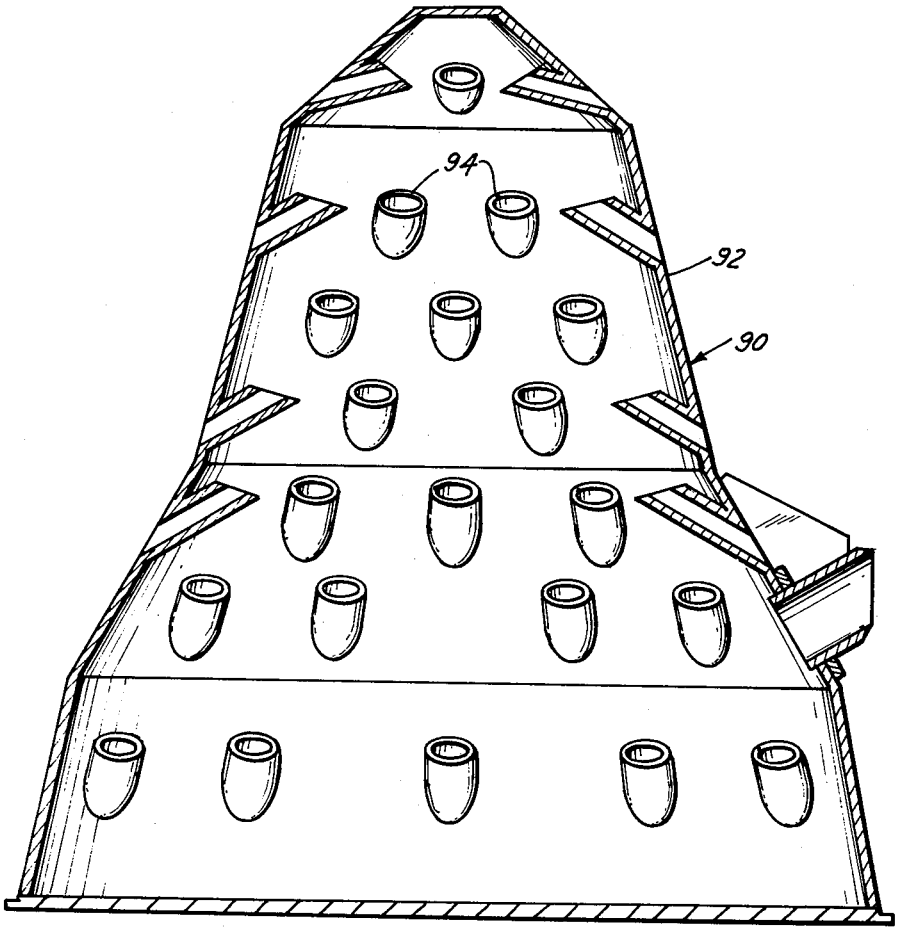
FIG. 9 is a vertical section through the closure plug similar to FIG. 4 but showing a modified form of gas flow openings.

Referring now to FIG. 9 of the drawings, in the plug 90 there shown the slots 66 are replaced by relatively large gas flow nipples. More particularly, plug 90 comprises a relatively thin frusto-conical wall 92 defining an unobstructed frusto-conical chamber and having the upwardly oriented gas flow nipple 94 mounted therein. The upward orientation of the nipples is provided to inhibit flow of particulate material from the reactor to the interior of the plug. By using such upwardly oriented conduits the gas flow area per opening can be made substantially larger than when the slots 66 are used.

From the foregoing description it should be apparent that the present invention provides an effective means for cooling the sponge iron or reducing the partially reduced ore at the very bottom of the reactor and thereby reducing the probability of the occurrence of "hot spots" in the cooled sponge iron discharged from the reactor or increasing the reducing efficiency of a reduction reactor.

It is of course to be understood that the foregoing description is intended to be illustrative only and that numerous changes can be made therein without departing from the spirit of the invention as set forth in the appended claims.

We claim:

1. Apparatus for the gaseous reduction of metal ores comprising a reactor adapted to contain a bed of particulate ore to be reduced and having a discharge port near the bottom thereof through which reduced metal ore can be discharged and a hollow, substantially frusto-conical, upwardly converging closure plug defining a substantially frusto-conical chamber therein and constructed and arranged to be positioned within and to seal said discharge port, said plug having an inlet connection for a cooling or heating fluid and a plurality of lateral openings through the frusto-conical wall of said plug through which said fluid can flow to the interior of said reactor.

2. Apparatus for the gaseous reduction of metal ores comprising a reactor adapted to contain a bed of particulate ore to be reduced and having a discharge port near the botton thereof through which reduced ore can be discharged, a hollow, substantially frusto-conical, thin-walled, upwardly converging plug defining an unobstructed frusto-conical chamber, constructed and arranged to be positioned within and to seal said discharge port, said plug having an inlet connection for a cooling or heating fluid and a plurality of openings formed in said thin wall through which said fluid can flow laterally from the interior of said plug to the interior of said reactor, and a fluid supply conduit extending through the wall of said reactor and having a discharge end within said reactor, the inlet connection of said plug being positioned to register with the discharge end of said supply conduit when said plug is positioned in said discharge port.

3. Apparatus according to claim 2 wherein said openings are elongated slots.

4. Apparatus according to claim 2 wherein said openings are formed by internal nipples mounted in the wall of said plug and extending upwardly into the interior thereof.

5. Apparatus according to claim 1 wherein the fluid flow openings of said plug are lateral openings interconnecting the interior of said plug and the interior of said reactor.

6. Apparatus according to claim 1 wherein the wall of said plug is provided with a plurality of relatively large openings to facilitate removal of particulate ore from the interior thereof.

7. Apparatus for the gaseous reduction of metal ores comprising a reactor adapted to contain a bed of particulate ore to be reduced and a discharge port near the bottom thereof through which the reduced ore can be discharged, a hollow, substantially frusto-conical, upwardly converging closure plug mounted for swinging movement from a reactor-closing position within said port to a reactor-dischsarge position away from said port, actuating means for moving said plug between said two positions, and a gas supply conduit extending through the wall of said reactor and having a discharge end positioned to deliver gas to said plug when said plug is in its reactor-closing position, said plug having a gas inlet nipple that extends into said supply conduit and is withdrawn therefrom when said plug moves from its reactor-closing to its reactor-discharge position.

8. Apparatus according to claim 7 wherein said actuating means comprises a system of pivoted levers connected to said plug.

9. Apparatus according to claim 8 wherein said system of pivoted levers includes a hydraulic power cylinder for actuating said lever system to swing said plug toward and away from said reactor.

10. A removable closure for the bottom discharge port of a gaseous reduction reactor for reducing metal ores comprising a hollow, substantially frusto-conical upwardly converging closure plug defining a substantially frusto-conical chamber therein, said plug having an inlet connection for a cooling or heating fluid and a plurality of lateral openings through the frusto-conical wall of said plug through which said fluid can flow to the interior of said reactor.

11. A removable closure according to claim 10 wherein said openings are elongated slots.

12. A plug according to claim 10 wherein said openings are formed by nipples mounted in the wall of said plug and extending upwardly into the interior thereof.

13. A removable closure according to claim 10 wherein the wall of said plug is provided with a series of relatively large openings to facilitate removal of particulate material from the interior thereof.

14. A removable closure according to claim 10 wherein the wall of said plug is provided with a hinged door to facilitate removal of particulate material from the interior of said plug.

15. A removable closure for the bottom discharge port of a gaseous reduction reactor for reducing metal ores comprising a hollow, substantially frusto-conical plug defining an unobstructed frustro-conical chamber and adapted to be positioned within and to seal said discharge port, said plug having an inlet connection for a cooling or heating fluid and a plurality of lateral openings through the frusto-conical wall of said plug interconnecting the interior of said plug and the interior of said reactor through which said fluid can flow to the interior of said reactor, said openings of said plug being elongated slots and the wall of said plug being provided with a series of relatively large openings to facilitate removal of particulate material from the interior thereof.

16. A removable closure for the bottom discharge port of a gaseous reduction reactor for reducing metal ores comprising a hollow, thin-walled, substantially frusto-conical plug defining an unobstructed frustro-conical chamber and adapted to be positioned within and to seal said discharge port, said plug having an inlet connection for a cooling or heating fluid and a plurality of lateral openings formed in said thin wall and interconnecting the interior of said plug and the interior of said reactor through which said fluid can flow to the interior of said reactor, said openings of said plug being elongated slots and the wall of said plug being provided with a series of relatively large openings to facilitate removal of particulate material from the interior thereof, and said wall also being provided with a hinged door to further facilitate removal of particulate material from the interior of said plug.

17. Apparatus for the gaseous reduction of metal ores comprising a reactor adapted to contain a bed of particulate ore to be reduced and having a discharge port near the bottom thereof through which reduced ore can be discharged, a hollow, substantially frusto-conical, upwardly converging plug constructed and arranged to be positioned within and to seal said discharge port, said plug having an inlet connection for a cooling or a heating fluid and a plurality of openings through which said fluid can flow to the interior of said reactor, and a fluid supply conduit extending through the wall of said reactor and having a discharge end within said reactor, said plug having a gas inlet nipple that extends into said supply conduit and is withdrawn therefrom when said plug is removed from said reactor.

18. Apparatus for the gaseous reduction of metal ores comprising a reactor adapted to contain a bed of particulate ore to be reduced and having a discharge port near the bottom thereof through which reduced ore can be discharged, a hollow, upwardly converging plug having a thin, substantially frusto-conical wall defining an unobstructed frusto-conical chamber, said frusto-conical wall extending uninterruptedly between opposite ends of said plug, said plug being constructed and arranged to be positioned within and to seal said discharge port and having an inlet connection for a cooling or heating fluid, said plug also having a plurality of openings formed therein through which said fluid can flow from the interior of said plug to the interior of said reactor, and a fluid supply conduit extending through the wall of said reactor and having a discharge end within said reactor, the inlet connection of said plug being positioned to register with the discharge end of said supply conduit when said plug is positioned in said discharge port.

* * * * *